United States Patent [19]

Ishihara et al.

[11] Patent Number: 4,754,593

[45] Date of Patent: Jul. 5, 1988

[54] BAG-MAKING-AND-FILLING PACKAGING APPARATUS

[75] Inventors: Hisamitsu Ishihara, Tokyo; Hisafumi Kobayashi; Nobuaki Kanno, both of Chiba, all of Japan

[73] Assignee: Tokyo Automatic Machinery Works, Ltd., Tokyo, Japan

[21] Appl. No.: 81,549

[22] Filed: Aug. 5, 1987

[30]

Foreign Application Priority Data

Dec. 28, 1985 [JP] Japan ..... 60-299523
Dec. 28, 1985 [JP] Japan ..... 60-299524

Related U.S. Application Data

[63] Continuation of Ser. No. 825,731, Feb. 3, 1986, abandoned.

[51] Int. Cl.[4] ..... B65B 51/14

[52] U.S. Cl. ..... 53/51; 53/64; 53/551

[58] Field of Search ..... 53/51, 451, 493, 550, 53/551, 55, 66, 64; 493/24

[56] References Cited

U.S. PATENT DOCUMENTS 3,889,446 6/1975 Simmons et al. ..... 53/451
4,023,327 5/1977 Simmons ..... 53/552 X
4,070,951 1/1978 Bala ..... 493/24
4,128,985 12/1978 Simmons ..... 53/551 X
4,288,965 9/1981 James ..... 53/551 X
4,391,079 7/1983 Cherney ..... 53/551 X
4,501,109 2/1985 Monsees ..... 53/551 X
4,525,977 7/1985 Matt ..... 53/55
4,546,596 10/1985 Cherney ..... 53/551 X

*Primary Examiner*—James F. Coan
*Attorney, Agent, or Firm*—Watson, Cole, Grindle & Watson

[57] ABSTRACT

This disclosure relates to an improvement of a bag-making-and-filling packaging apparatus in which a web supplied from a roll of packaging material is formed into a tube through a tube-forming member and intermittently delivered and the formed tube is filled with a material to be packaged and when the filling is completed, the tube is sealed along the width thereof. The apparatus comprises an improved packaging material delivery device which is effective to assure durability of delivery means and to prevent damage to the packaging material for good packaging finish as well as to increase precision of delivery of the packaging material, and an improved registering device in which setting and adjusting operation of registering is facilitated and the structure associated with a register mark sensor is simplified.

9 Claims, 7 Drawing Sheets

BAG-MAKING-AND-FILLING PACKAGING APPARATUS

This application is a continuation of application Ser. No. 825,731, filed Feb. 3, 1986, now abandoned.

BACKGROUND OF THE INVENTION

1. Field of the Invention

The present invention relates to a bag-making-and-filling packaging apparatus, and more specifically to improvement of delivering and registering systems of packaging material for a bag-making-and-filling packaging apparatus in which a web supplied from a roll of packaging material is formed into a tube through a tube-forming member and intermittently delivered and the formed tube is filled with a material to be packaged and when the filling is completed, the tube is sealed along the width thereof.

2. Description of the Prior Art

The conventional packaging apparatus comprises downstream of a tube-forming member delivery means, such as delivery belts or rollers, having a driving member and adapted for intermittent delivery by constantly rotating the driving member and then stopping it so as to obtain a predetermined length of delivery In such a conventional system, however, slippage between the delivery belts or rollers and the packaging material, error in precision and control of mechanical components and others cause the delivered length different from a set length and fluctuation of delivery length.

In another prior art system as disclosed in Japanese Patent Publication No. 59-3325 (corresponding to U.S. Pat. No. 4,288,965), there is provided upstream of the tube-forming member a delivery roller which is adapted to deliver the web as well as to measure the delivery length.

In this prior art system, however, it is required to dispose downstream of the tube-forming member a delivery belt so as to keep the packaging material downstream of the delivery roller in the strained condition. Then, great load is applied to the belt, and at the same time, the system is designed to intentionally cause slippage between the belt and the packaging material, resulting in lowered durability of the belt and damage to the packaging material due to the slippage.

The above bag-making-and-filling packaging apparatus includes a registering system or, more in detail, system in which, when each of boundary portions of patterns, such as pictures, trademarks and indications, printed on the web of the packaging material at regular intervals corresponding to packaging length reaches the position of a sealing device, travel of the web is stopped. In this system, the web with register marks is supplied from a roll of packaging material and delivered to travel by delivery means, and there is provided on the web-travelling path a sensor for detecting the register marks, and the driving member of the delivery means is stopped when the sensor detects a register mark.

In such a prior art registering system, immediately after the sensor detects a register mark, the clutch of the driving member of the delivery means is disengaged to stop travel of the web, and if packaging materials having various register mark pitches are used, it is required to move the position of the register mark sensor along the web-travelling path through operation of a handle so as to adjust stop timing of the web.

If there is any positional shifting of patterns during operation using a packaging material, adjustment by moving the sensor is also required.

Thus, such a registering system not only requires much time for setting and adjustment, but also lacks in reproducibility, resulting in poor performance, and, furthermore, it has a defect that, as the sensor must include a moving structure, attachment structure of the sensor is complicated.

SUMMARY OF THE INVENTION

It is, accordingly, an object of the present invention is to provide a bag-making-and-filling packaging apparatus which can eliminate the above disadvantages associated with the prior art packaging material delivery system and is effective to assure durability of the delivery means and to prevent damage to the packaging material for good packaging finish as well as to increase precision of delivery of the packaging material.

It is another object of the present invention to provide a bag making-and-filling packaging apparatus in which, in order to eliminate the disadvantages associated with the prior art registering system, a register mark sensor is fixed at a predetermined position and stop timing of the web is variable so as to facilitate setting and adjusting operation of registering as well as to simplify the structure associated with the sensor.

According to the present invention, there is provided a bag-making-and-filling packaging apparatus in which a web supplied from a roll of packaging material is formed into a tube through a tube-forming member and intermittently delivered and the formed tube is filled with a material to be packaged and when the filling is completed, the tube is sealed along the width thereof, comprising a packaging material delivery device having web delivery means disposed on a web-travelling path downstream of the forming member and measuring means disposed upstream of the forming member and adapted for measuring the run length of the web, said delivery means having a driving member which is stopped when the measuring means detects a set length of the web travel; and a registering device having a register mark sensor disposed on the web-travelling path upstream of the forming member, the register mark sensor and the measuring means being connected through a control system to the driving member of the delivery means, the control system including an offset counter for counting measurement value of the measuring means and input means for inputting a set value and having an offset sequence which actuates the offset counter when the sensor detects a register mark, the driving member of the delivery means being stopped when the measurement value of the counter comes up to the set value.

The present invention will become more fully apparent from the claims and description as it proceeds in connection with the drawings.

BRIEF DESCRIPTION OF THE DRAWINGS

FIGS. 6*a* to 6*c* are flow diagrams illustrating operation of the control system in FIG. 4, in which FIG. 6*a* is a flow diagram when an encoder is rotated in the forward direction;

FIG. 6*b* is a flow diagram when a register mark is detected; and

FIG. 6*c* is a flow diagram when the encoder is rotated in the reverse direction.

DETAILED DESCRIPTION OF THE PREFERRED EMBODIMENTS

Figure 1:
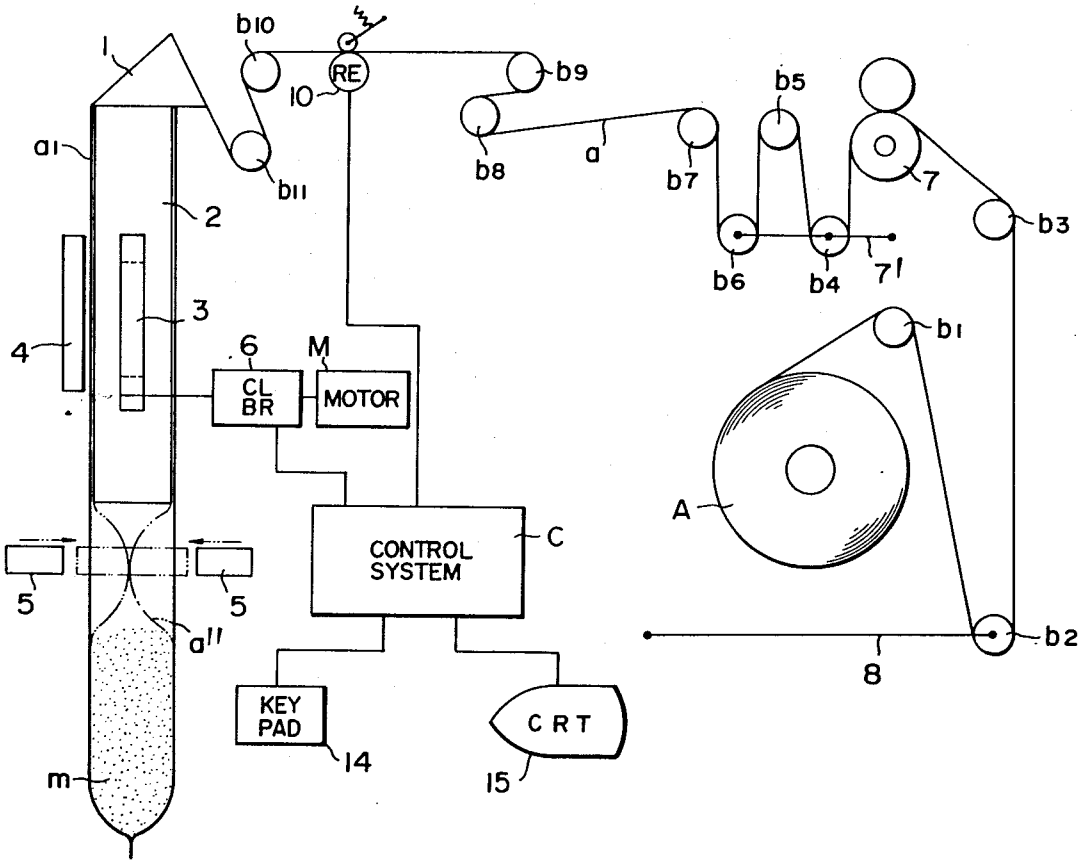
FIG. 1 is a block diagram of the structure of a preferred embodiment in accordance with the present invention.

Referring now to FIG. 1 in the drawings, there is illustrated a vertical type bag-making-and-filling packaging apparatus which comprises a tube-forming member 1, a bag-making cylindrical member 2 depending from the forming member 1, a pair of delivery belts 3 serving as delivery means, a vertical sealing device 4, a transverse sealing device 5 and a film roll A of wound packaging film or web a.

The web a drawn out from the film roll A is properly introduced through guide rollers b1, b2, b3 . . . to the tube-forming member 1. The web a is formed cylindrically when passing through the forming member 1, and then moves down in form of a tube a' along the outer periphery of the cylindrical member 2.

The path of the web a moving from the film roll A to the position under the cylindrical member 2 will be hereafter called a web-travelling path.

The delivery belts 3 come into contact with the outer periphery of the tube a' and imparts to the web a downward delivery force, which causes the web a to be drawn out against a tension lever 7' and to move along the web-travelling path.

The delivery belts 3 are disposed on the opposite sides of the outer periphery of the cylindrical member 2, and driving shafts of the delivery belts 3 are connected to a motor M through a clutch and brake 6 which starts and stops rotation of the shafts at proper times to perform intermittent rotation thereof and thereby to intermittently deliver the web a and the tube a'.

When the tube a' moves down along the cylindrical member 2, vertical joint edges of the tube a' are sealed by the sealing device 4. When the tube a' is lowered below the cylindrical member 2, a predetermined amount of material m to be packaged is supplied down through the cylindrical member 2 into the tube a', which is then sealed at the position above the material m packaged therein by the sealing device 5, and, if required, the sealing device 5 may include a knife which is adapted to cut the sealed portion of the tube a' at the middle thereof transversely or along the width thereof so as to separate a bag a'' from the lower end of the tube a'.

As shown in the drawing, there are provided an auxiliary delivery roller 7 for reducing the force required to draw out the web a from the film roll A, a tension lever 7' adapted for turning on and off the driving member of the delivery rollers 7 and serving as buffer for the web a, and another tension lever 8 for applying the brake at proper times to the web a drawn out from the film roll A.

There is provided on the web-travelling path, or more specifically on the path upstream of the tube-forming member 1, an encoder 10 serving as measuring means. The encoder 10 is connected through a control system C incorporating a computer to the driving member of the delivery belts 3, that is, the clutch and brake 6 so as to control start and stop of the delivery belts 3.

The encoder 10 is disposed in opposition to the web a travelling along the web-travelling path, rotatable in the forward and reverse directions at the speed corresponding to the travelling speed of the web a. The encoder 10 transmits pulses corresponding to the run length of the web a moving on the encoder 10 to a central processing unit CPU of the control system C in order to measure the actual run length of the web a.

Figure 2:
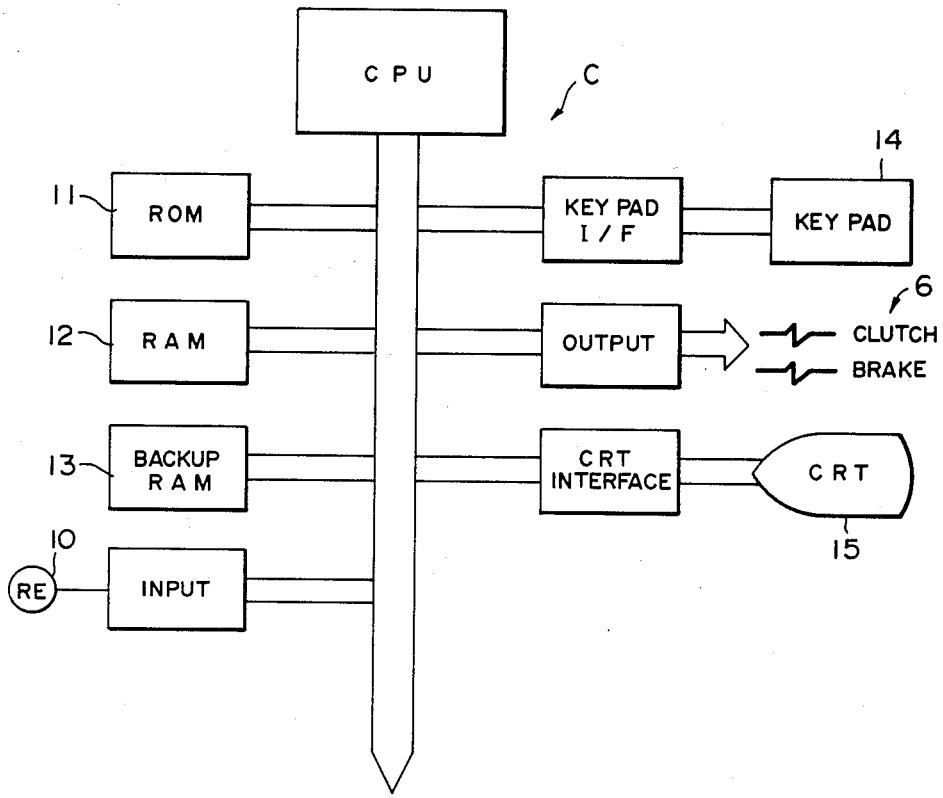
FIG. 2 is a block diagram of the control system in FIG. 1.

The control system whose block diagram is shown in FIG. 2 comprises ROM 11 or memory in which fixed data such as a time lag value and programs are written, RAM 12 or memory for writing input data, such as, write count of pulses transmitted from the encoder 10, that is, plus pulses at forward rotation (advance of web) and minus pulses at reverse rotation (retraction of web), and a backup RAM 13 or memory for storing set data such as pulse number which determines delivery length of the web a, and the set data is inputted by means of a key pad 14 which is a data input unit.

CRT 15 in the drawing is a display device.

Figure 3:
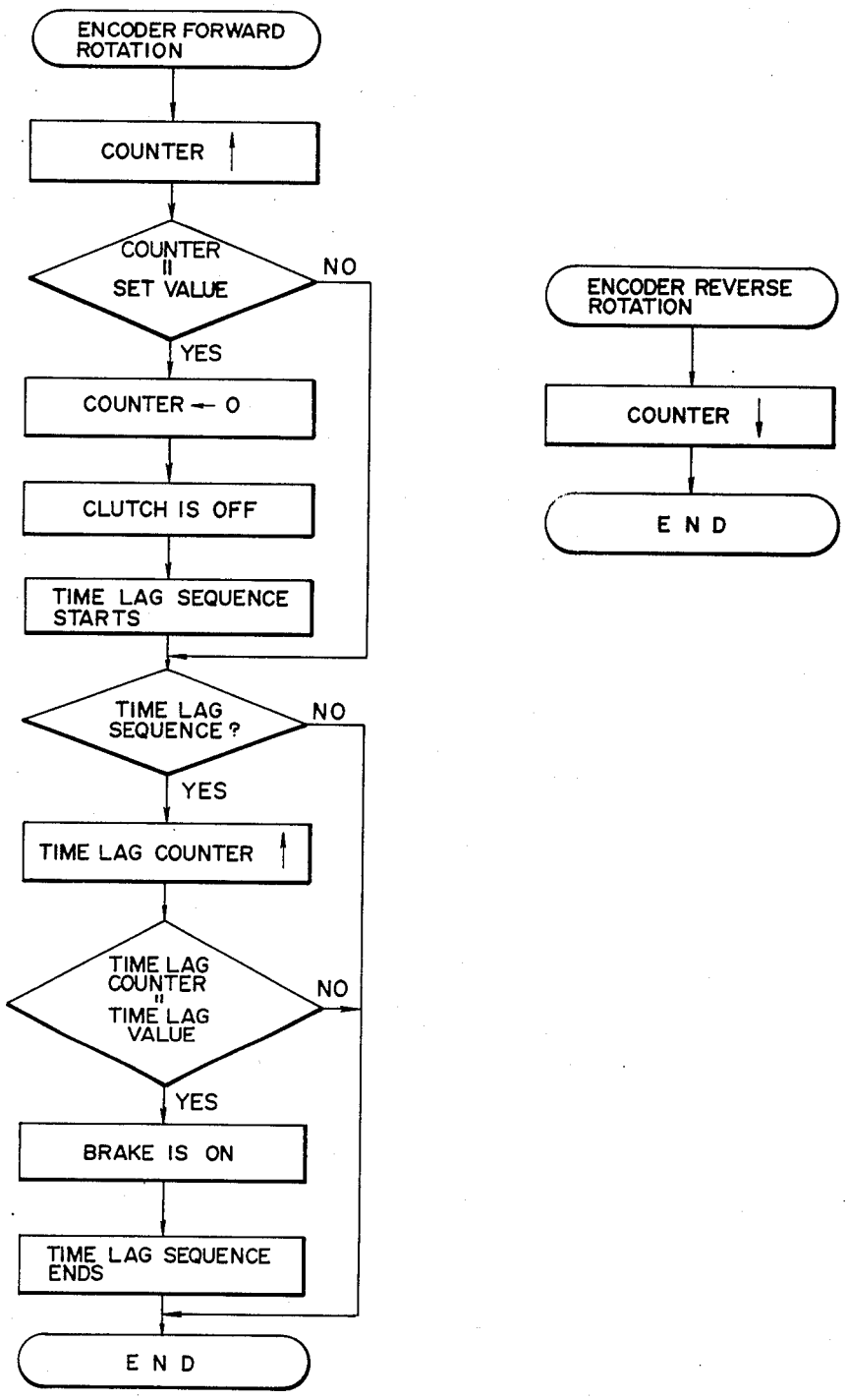
FIG. 3 is a flow diagram illustrating operation of the control system.

In the above control system, when the brake of the clutch and brake 6 is turned off and the clutch thereof on, the delivery belts 3 are actuated to start delivering of the web a and, as the result, the web a travels to cause forward rotation of the encoder 10 and the operation in FIG. 3 is executed.

In other words, forward rotation of the encoder 10 causes the counting operation (counter) of RAM 12 to count the amount of rotation (pulse count) of the encoder 10, and when the count comes up to the set value of RAM 13, RAM 12 is reset to zero, and the time lag sequence is started.

In the time lag sequence, a predetermined length of web travel is performed with the clutch of the clutch and brake 6 off, after RAM 12 is reset to zero, and then the counter of RAM 12 starts counting of time lag and when the count comes up to the set time lag value stored in RAM 13, the brake of the clutch and brake 6 is turned on to stop the delivery belts 3.

During the above operation, material to be packaged is fed through the cylindrical member 2, and with the delivery belts 3 kept in a stop condition, the sealing device 5 performs sealing. When the sealing by the sealing device 5 is completed, the delivery belts 3 are restarted to repeat the above mentioned operation.

As the delivery belts 3 repeat start and stop to intermittently deliver the web a, the web a will be slackened due to inertia thereof downstream of the encoder 10, for example, at the guide roller b10, when the delivery belts 3 are stopped or the brake is turned on. However, as the slackened length of the web a is measured by the encoder 10 and added to the count of RAM 12 in the following web delivery cycle, there remains no fear of error in web delivery.

In the following delivery cycle, before delivering is started, back tension is applied to the web a to draw it back toward the upstream side, so that some of the slackened length of the web a is drawn back toward the upstream side of the encoder 10. At occurance of such a phenomenon, however, as the encoder 10 reversely rotates and the value corresponding to the retracted length of the web a is subtracted from the count of RAM 12, no error in web delivery occurs.

Though the delivery belts are used as delivery means in this embodiment, other means such as delivery rollers may be employed, and measuring means may be freely selected from means other than the encoder.

Though the operation of the above embodiment is explained in relation to the case proceeding to the time lag sequence, the sequence may be omitted and the delivery belts may be designed to be stopped immediately when the encoder 10 measures the set length of the web.

Furthermore, if desired, the bag-making cylindrical member 2 may be replaced by tubeless guide means.

With this construction according to the present invention, the measuring means measures the actual run length of the web and the delivery belts are stopped based upon the result, so that, even if there is any slippage between the delivery means and the web or tube or any error in mechanical precision, the delivering length of the web can be kept constant to improve the delivery precision of the packaging material.

Furthermore, as it is not necessary to cause intentional slippage between the delivery means and the web or tube, the load applied to the delivery means can be reduced, so that durability of the means is improved because of less wear or damage thereto and also damage to the packaging material is prevented.

Figure 4:
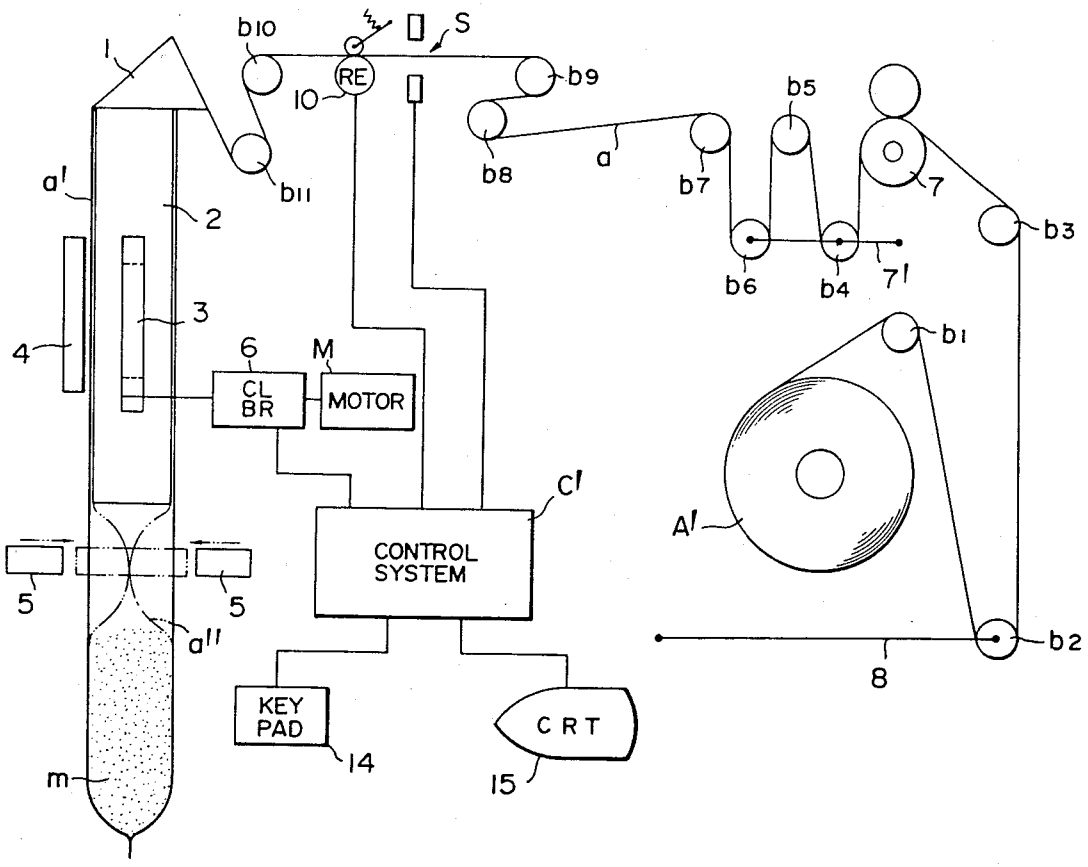
FIG. 4 is a block diagram of the structure of another embodiment in accordance with the present invention.
Figure 5:
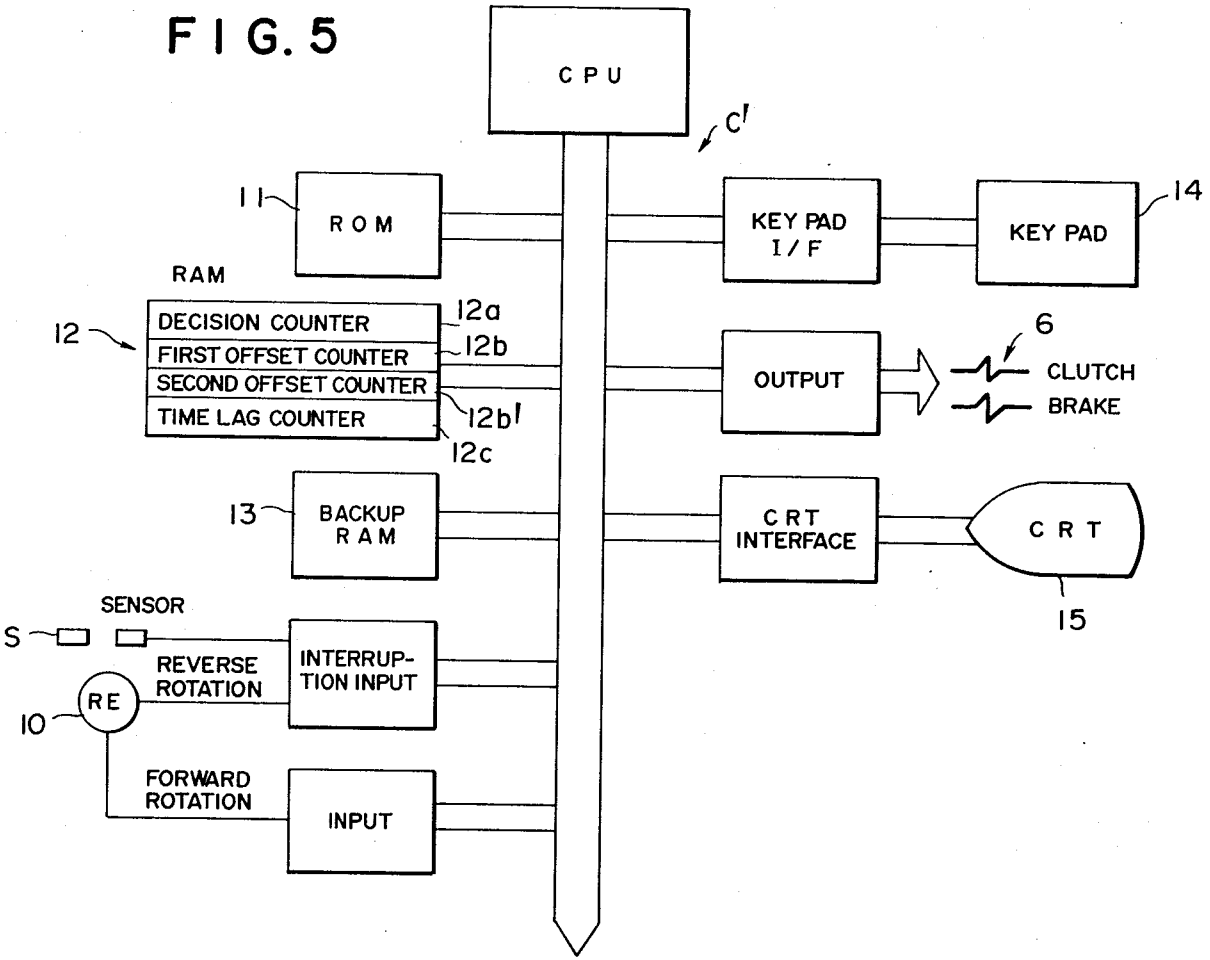
FIG. 5 is a block diagram of the control system in FIG. 4.
Figure 6A:
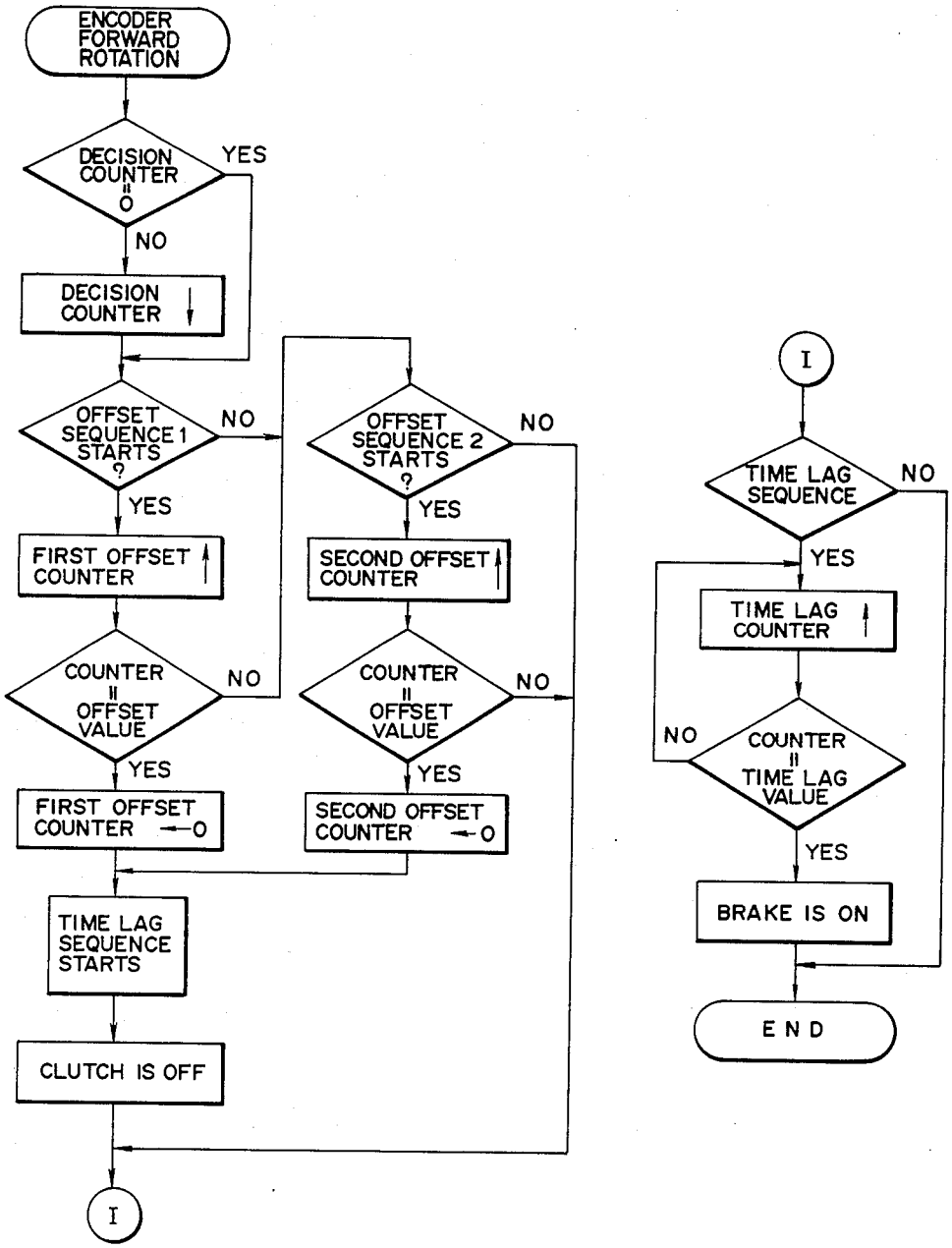
Figure 6B:
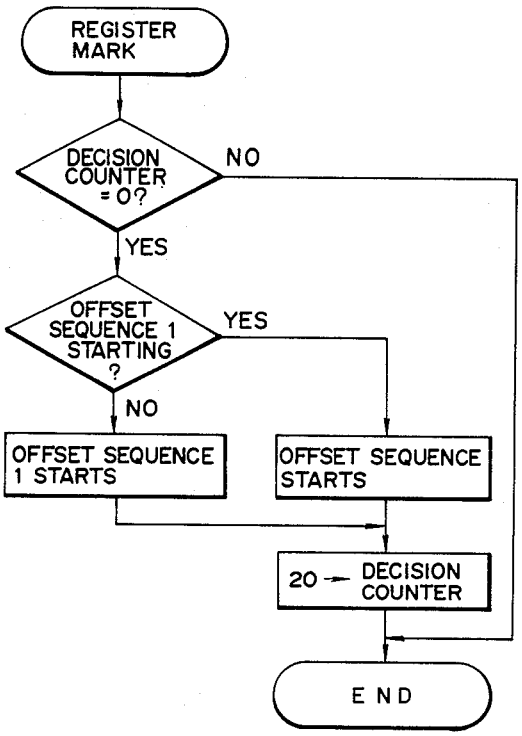
Figure 6C:
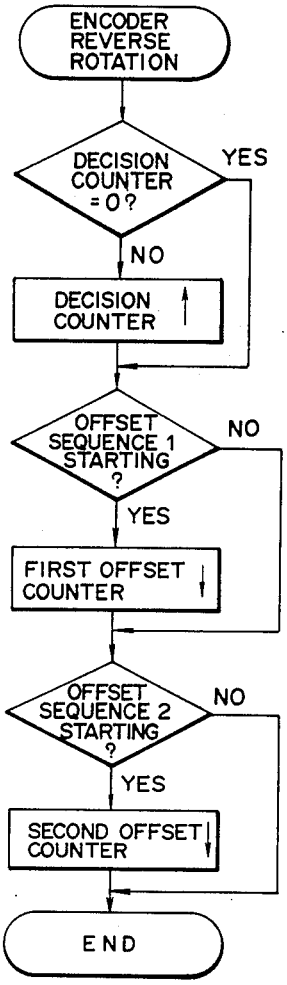

FIGS. 4 to 6 illustrate another embodiment of the present invention in which a registering system is combined to the apparatus shown in FIGS. 1 to 3. As shown in FIG. 4, the construction is almost the same as that shown in FIG. 1 except a register mark sensor S provided on the web-travelling path, a film roll A' of wound web a having register marks put thereon at regular intervals and a control system C'. Like parts are given like reference numbers and any further description will be omitted to simplify the explanation.

As shown in FIG. 4, the register mark sensor S is disposed along with the encoder 10 on the web-travelling path, or more specifically on the path upstream of the tube-forming member 1. The encoder 10 and the sensor S are connected through the control system C' to the driving member of the delivery belts 3, that is, the clutch and brake 6 so as to control start and stop of the delivery belts 3.

The control system C' whose block diagram is shown in FIG. 5 comprises ROM 111 or memory for storing fixed data such as decision value for deciding whether or not the register mark is valid and time lag value and control data such as programs, and RAM 112 or memory which receives output signals from the encoder 10 and the register mark sensor S and have a counter function of counting pulse signals transmitted from the encoder 10.

A backup RAM 113 is a memory for storing set values such as offset values to determine the run length of the web after a register mark is detected, and the set values are variably inputted by a key pad 14 which is a data input unit.

The counter function of the RAM 112 is executed by a reversible register mark decision counter 112*a* whose count is added to the decision value of ROM 111 at forward rotation of the encoder 10 and is subtracted therefrom at its reverse rotation, a first offset counter 112*b* which is incremented at forward rotation of the encoder 10 in the offset sequence after a register mark is detected, a second offset counter 112*b'* and a time lag counter 112*c* which is incremented at forward rotation of the encoder 10 in the time lag sequence after the counts of the first and second counters come to the offset values.

CRT 15 in FIG. 5 is a display device.

Control operation of the control system C' is shown in FIG. 6. Fixed data of 20 mm decision value and 7 mm time lag value is previously stored in ROM 111, and the set values such as offset values are previously inputted digitally into the backup RAM 113 of the control system C' by means of the key pad 14, and then the packaging apparatus is started.

When the apparatus is started, the brake of the clutch and brake 6 is turned off and the clutch thereof on to actuate the delivery belts and, the delivery of the web is started, and accordingly the web a travels and the encoder 10 rotates to perform measurement.

At first, during travel of the web a, forward rotation of the encoder 10 causes the register mark decision counter 112*a* of RAM 112 to subsequently decrement the decision count from 20 to 0.

When a register mark of the web a is detected by the sensor S during travel of the web a, it is decided whether or not the decision counter 112*a* is zeroed at the point, and if it is zeroed, the operation is proceeded to the offset sequence by a register mark detecting signal.

In the offset sequence illustrated in the drawing, an offset sequence 1 in which the first offset counter 112*b* is operated and an offset sequence 2 in which the second offset counter 112*b'* is operated are programmed. If the offset sequence 1 is started, the first offset counter 112*b* counts the amount of rotation (pulse count) of the encoder 10 in response to the travel of the web a. When the count reaches the offset value of RAM 113, the first offset counter of RAM 112 is reset to zero and the decision counter is reset to 20, and then the operation is proceeded to the time lag sequence.

In the time lag sequence, a predetermined length of web travel is performed with the clutch of the clutch and brake 6 off, after RAM 112 is reset to zero, and then the time lag counter 112*c* of RAM 112 starts counting, and when the count reaches the time lag value stored in ROM 111, the brake of the clutch and brake 6 is turned on to stop the delivery belts 3.

During the above operation, material to be packaged is fed through the cylindrical member 2, and with the delivery belts 3 kept in a stop condition, the sealing device 5 performs sealing. When the sealing by the sealing device 5 is completed, the delivery belts 3 are restarted to repeat the above mentioned operation.

As the delivery belts 3 repeat start and stop to intermittently deliver the web a, the web a will be retracted or moves to and fro reciprocatingly on the sensor S due to slack of the web a, when the delivery belts 3 are stopped, and in such a case, the sensor S may detect the same register mark more than twice.

At occurance of such a phenomenon, the encoder 10 is reversely rotated or repeats small amounts of forward and reverse rotations. The decision counter 112*a* of RAM 112 is incremented at forward rotation of the encoder 10 and decremented at reverse rotation thereof, and when the sensor S detects a register mark, it is decided whether or not the decision counter is zeroed.

If the decision counter 112*a* is not zeroed, the detected register mark is decided to be the one previously detected, and transition to the offset sequence caused by detection of the register mark is inhibited to prevent malfunctions of the delivery belts 3.

Such a process of preventing duplicate detection of a register mark by the decision counter is also effective to prevent malfuctions caused by, such as, misprint of register marks.

Though, in the above embodiment, there are provided two offset sequences for the operation, it is of course possible to perform the operation in a single offset sequence.

In the embodiment shown in FIG. 4, stop time of the delivery means can be varied by inputting the set values (offset values) to the control system by the input unit so as to set or adjust stop timing of the web. Therefore, the registering operation of the packaging material is remarkably facilitated in comparison with the conventional sensor-moving system, and also has a good reproducibility. Furthermore, as the measuring means measures the actual length of the web travel in the offset sequence, the set amount of the web delivery can be kept constant to improve delivery precision.

As the sensor is fixed at a position, attachment structure thereof is simple in comparison with that for a moving sensor, so that the structure associated with the sensor can be simplified.

While the invention has been described with reference to preferred embodiments thereof, it is to be understood that modifications or variations may be easily made without departing from the scope of this invention which is defined by the appended claims.

What is claimed is:

1. A bag-making-and-filling apparatus in which a web supplied from a roll of packaging material is formed into a tube through a tube-forming member and intermittently delivered and the formed tube is filled with a material to be packaged when the filling is completed, the tube is sealed along the width thereof, comprising web delivery means disposed on a web-travelling path downstream of the forming member and measuring means disposed upstream of the delivery means and in direct contract with the web so as to be able to measure the actual run length of the web, said means for measuring the run length of the web being a non-driven rotary encoder and being rotatable in both forward and reverse directions at a speed corresponding to the speed of the web, said measuring means providing signals to a control system including a computer, said delivery means having a driving member which is started and stopped by said control system after a predetermined length of the web travel, said control system including a time lag sequence such that a predetermined length of the web is delivered after a counter is reset at zero by means of said time lag sequence and the counter begins to count in response to the direction of travel of the web; the counter of the control system counting plus pulse at the forward rotation of the encoder and minus pulse at reverse rotation of the encoder.

2. The apparatus as defined in claim 1, wherein said delivery means includes a pair of delivery belts disposed on the opposite sides of the outer periphery of a bag-making cylindrical member, said delivery belts having driving shafts connected through a clutch and brake to a motor, and said measuring means upstream of the forming member and connected through a control system to said clutch and brake, start and stop of said delivery belts being controlled by said control system.

3. The apparatus as defined in claim 2, wherein said control system comprises a ROM in which predetermined fixed date and control data such as programs are written, a RAM in which input data from said encoder is written, and a backup RAM for storing set data such as pulse count for determining delivery length of the web.

4. The apparatus as defined in claim 1, wherein the web has register marks thereon at regular intervals and said apparatus further comprises a register mark sensor disposed upstream of the tube-forming member and adapted for detecting the register marks, said register mark sensor and said measuring means being connected through a control system to the driving member of said delivery means, said control system including an offset counter for counting measurement value of said measuring means and input means for inputting a set value and having an offset sequence which actuates the offset counter when said sensor detects a register mark, the driving member of said delivery means being stopped when the measurement value of said counter comes up to the set value.

5. The apparatus as defined in claim 4, wherein said control system further includes register mark decision means for inhibiting operation of the offset sequence when said sensor detects a previously detected register mark.

6. The apparatus as defined in claim 4, wherein said delivery means includes a pair of delivery belts disposed on the opposite sides of a bag-making cylindrical member, said delivery belts having driving shafts connected through a clutch and a brake to a motor, and said measuring means includes a rotary encoder rotatable in the forward and reverse directions.

7. The apparatus as defined in claim 6, wherein said control system comprises a ROM in which fixed data such as decision value for deciding whether or not the register mark is valid and control data such as programs are written, a RAM which receives output signals from said encoder and said register mark sensor and has a function of counting pulse signals transmitted from said encoder, and a backup RAM for storing set values such as offset value to determine the run length of the web after a register mark is detected.

8. The apparatus as defined in claim 7, wherein the counter function of said RAM of the control system is executed by a reversible register mark decision counter whose count is added to the decision value of ROM at forward rotation of said encoder and is substracted therefrom at its reverse rotation, an offset counter which is incremented at forward rotation of said encoder in the offset sequence after a register mark is detected, and a time lag counter which is incremented at forward rotation of said encoder in a time lag sequence after the count of said time lag counter comes to the offset value.

9. The apparatus as defined in claim 8, wherein said offset counter includes two units which operate alternately.

* * * * *